US011391496B2

(12) United States Patent
Tanawittayakorn

(10) Patent No.: US 11,391,496 B2
(45) Date of Patent: Jul. 19, 2022

(54) REFRIGERATING CYCLE APPARATUS

(71) Applicant: SIAM COMPRESSOR INDUSTRY CO., LTD., Chonburi (TH)

(72) Inventor: Wasan Tanawittayakorn, Chonburi (TH)

(73) Assignee: SIAM COMPRESSOR INDUSTRY CO., LTD., Chonburi (TH)

( * ) Notice: Subject to any disclaimer, the term of this patent is extended or adjusted under 35 U.S.C. 154(b) by 63 days.

(21) Appl. No.: 16/759,391

(22) PCT Filed: Nov. 1, 2017

(86) PCT No.: PCT/TH2017/000079
§ 371 (c)(1),
(2) Date: Apr. 27, 2020

(87) PCT Pub. No.: WO2019/088932
PCT Pub. Date: May 9, 2019

(65) Prior Publication Data

US 2020/0292216 A1 Sep. 17, 2020

(51) Int. Cl.
*F25B 43/02* (2006.01)
*F25B 31/00* (2006.01)

(52) U.S. Cl.
CPC ..... *F25B 31/004* (2013.01); *F25B 43/02* (2013.01); *F25B 2313/0253* (2013.01);
(Continued)

(58) Field of Classification Search
CPC ..... F25B 31/004; F25B 43/02; F25B 2313/0253; F25B 2400/075;
(Continued)

(56) References Cited

U.S. PATENT DOCUMENTS 10,443,910 B2 * 10/2019 Kimura ..... F25B 31/004
2009/0031737 A1 * 2/2009 Ueno ..... F25B 13/00 62/151
(Continued)

FOREIGN PATENT DOCUMENTS

EP 1 610 070 A1 12/2005
EP 2 397 793 B1 5/2013
(Continued)

OTHER PUBLICATIONS

International Search Report of the International Searching Authority dated May 30, 2018 for the corresponding International application No. PCT/TH2017/000079.

*Primary Examiner* — Henry T Crenshaw
*Assistant Examiner* — Kamran Tavakoldavani
(74) *Attorney, Agent, or Firm* — Posz Law Group, PLC

(57) ABSTRACT

A refrigerating cycle apparatus is equipped with a plurality of outdoor units, each of which includes at least one high-pressure type compressor with refrigerant and lubricating oil stored therein. A discharge pipe of the respective compressor is connected to a main discharge pipe for jointly discharging refrigerant and oil to the indoor unit. A suction pipe of the respective compressors is connected for returning the refrigerant and the oil from the indoor unit to the compressor. Each outdoor unit comprises a first oil balancing circuit connected between a side surface of the casing of the respective compressor and the main discharge pipe for allowing a flowing-in of the exceeding oil from the casing of the compressor. In another embodiment, each outdoor unit may include a second oil balancing circuit connected between a side surface of the casing of the respective compressor and the main suction pipe.

6 Claims, 6 Drawing Sheets

(52) U.S. Cl.
CPC ..... *F25B 2400/075* (2013.01); *F25B 2500/16* (2013.01); *F25B 2700/03* (2013.01)

(58) Field of Classification Search
CPC ..... F25B 2400/06; F25B 2500/16; F25B 2700/03; F25B 5/02; F25B 31/002; F25B 41/20; F25B 2313/025; F25B 2600/25; F25B 2600/2515
USPC ..... 62/468
See application file for complete search history.

(56) References Cited

U.S. PATENT DOCUMENTS

| | | | | |
|---|---|---|---|---|
| 2014/0331712 | A1* | 11/2014 | Kan | F25B 43/02 62/470 |
| 2015/0114013 | A1* | 4/2015 | Joo | F25B 49/02 62/84 |
| 2019/0047362 | A1* | 2/2019 | Suzuki | B60H 1/00907 |
| 2019/0383533 | A1* | 12/2019 | Ochiai | F25B 13/00 |

FOREIGN PATENT DOCUMENTS

| | | | |
|---|---|---|---|
| EP | 3 067 644 | A1 | 9/2016 |
| JP | H08-159580 | A | 6/1996 |
| WO | 2009/054570 | A1 | 4/2009 |

* cited by examiner

REFRIGERATING CYCLE APPARATUS

CROSS REFERENCE TO RELATED APPLICATION

This application is a U.S. national stage application of PCT/TH2017/000079 filed on Nov. 1, 2017, the contents of which are incorporated herein by reference.

TECHNICAL FIELD OF THE INVENTION

The present invention relates to a refrigerating cycle apparatus equipped with a plurality of outdoor units. Each outdoor unit has at least one high pressure type compressor. More specifically, the invention relates to improvement of oil balancing between the compressors in each outdoor unit.

BACKGROUND ART

In a refrigerating cycle apparatus, a plurality of high pressure type compressors are provided having a casing held with a lubricating oil in which the discharging tube and suction tube of these compressors are mutually connected. In the prior art, an imbalance occurs between an amount of lubricating oil discharged from each compressor in a state to be mixed in a refrigerant and an amount of lubricating oil returned back to the respective compressor and sometimes there will occur an oil shortage in the compressors. If such oil shortage occurs, the supply of the oil to sliding motion parts of the compressor is interrupted, thus exerting a bad effect on the service life of the compressor.

In order to solve such problem, a refrigerating cycle apparatus has been proposed. For example, in the Japanese patent Publication No. JPH08159580 A, an oil balancing tube is connected between a side of one compressor and a suction tube of an associated compressor to allow the exceeding oil from the one compressor to be returned back to the associated compressor. However, the oil balancing tubes may involve a complex connection.

In the refrigerating cycle apparatus where there are more than one outdoor unit, problems, such as oil leakage from the interconnected oil balancing pipes' joints and fittings and pipe clog due to dirt and debris during unit installation, caused by unskillful workers, can easily occur and may cause severe damages to the compressor.

In EP 2 397 793B1, a refrigerating cycle apparatus with a plurality of outdoor units is disclosed. The oil amount of the compressor in the respective outdoor units is detected whether it is at a correct level by detecting temperature of the flow substance (refrigerant or oil) in the oil balancing tubes. However, this makes the apparatus complex and incurs high cost. Further, the apparatus still requires oil balancing tubes mutually connected between each outdoor unit.

SUMMARY OF THE INVENTION

In one aspect of the present invention, a refrigerating cycle apparatus is provided which can simply balance oil level of each compressor in each outdoor unit without installation of oil balancing pipes between each outdoor units. This can alleviate the above-mentioned problems, such as oil leakages from the interconnected oil balancing pipes' joints or pipe clog due to installing the interconnected oil balancing pipes after installing multiple outdoor units.

In one embodiment, the refrigerating cycle apparatus is equipped with a plurality of outdoor units, each of which includes at least one high-pressure type compressor. Each one of the compressor has a casing hold therein an oil. A discharge pipe and a suction pipe are connected to the high-pressure side and the low-pressure side of the compressor, respectively. Each one of the discharge pipes of the respective compressor is connected to a main discharge pipe for jointly discharging refrigerant and oil to the indoor unit. Each one of the suction pipes of the respective compressors is connected for returning the refrigerant and the oil from the indoor unit to the compressor. Each one of the plurality of outdoor units comprise a first oil balancing circuit connected between a side surface of the casing of the respective compressor and the main discharge pipe for allowing a flowing-in of an excess amount of the oil in the casing of the respective compressor.

In another embodiment, the refrigerating cycle apparatus may further include a second oil balancing circuit connected between a side surface of the casing of the respective compressor and the main suction pipe. The first and second balancing circuits may be operated periodically and sequentially and controlled by electronic valves.

Therefore, oil balancing between the compressors of the plurality of outdoor units can be realized more efficiently.

In one aspect of the invention, each one of the compressor may further comprise an oil level sensor for detecting oil level of the oil in the casing of the respective compressor.

DETAILED DESCRIPTION

Embodiment 1

Figure 1:
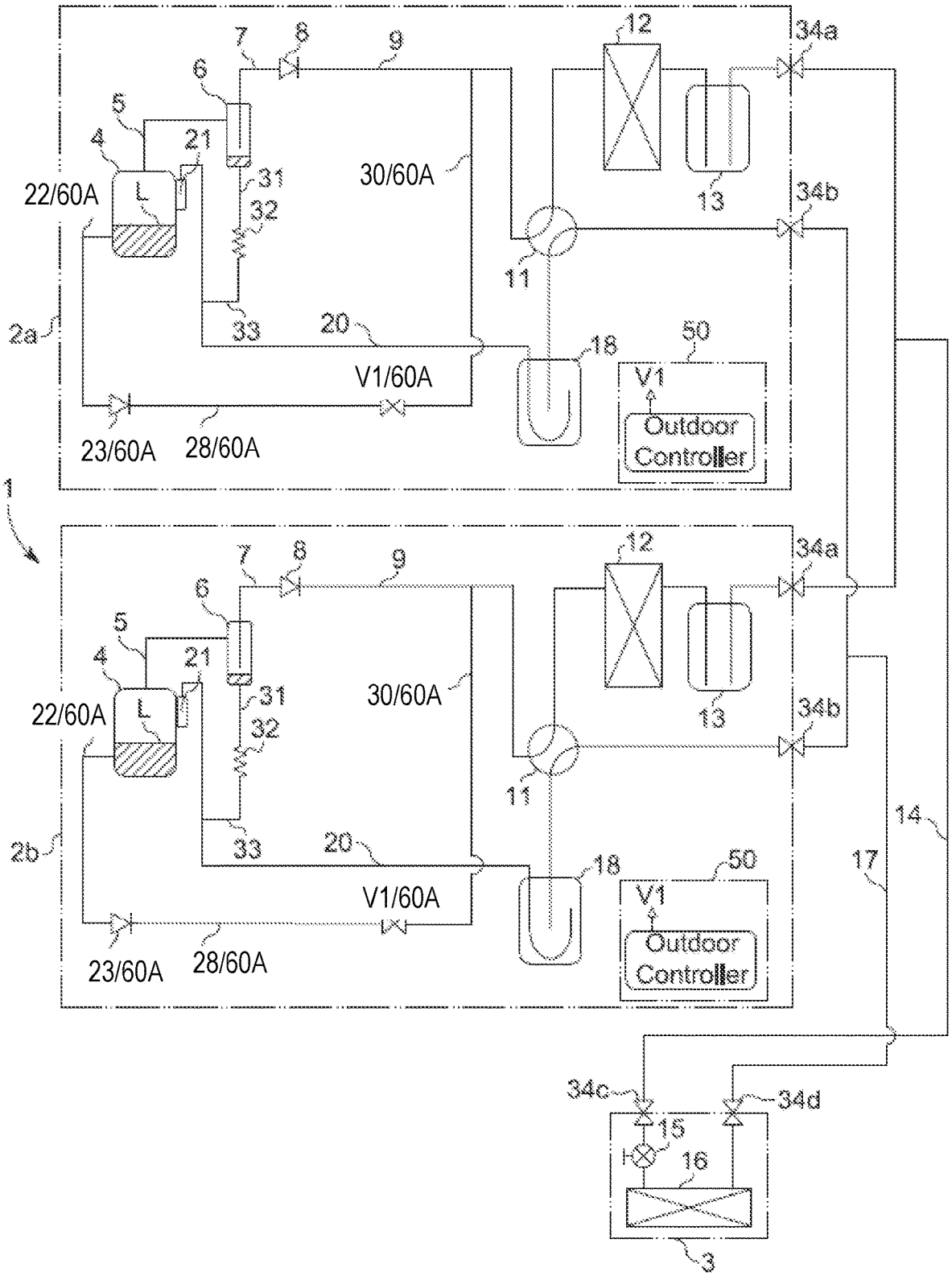
FIG. 1 is a circuit diagram of refrigerating cycle apparatus that include one compressor in each outdoor unit according to an embodiment 1 of the present invention.

The embodiment 1 of the present invention will be described based on the FIG. 1. A refrigerating cycle apparatus 1 is comprised of an air conditioner comprising a plurality of outdoor units 2*a*, 2*b* and an indoor unit 3. As for the indoor unit 3, not only one but also a plurality of units may be connected. Each one of the outdoor units 2*a*, 2*b* include at least one high pressure type compressor 4, an oil separator 6, a discharge check valve 8, a four-way valve 11, an outdoor heat exchanger 12, a receiver tank 13, an accumulator 18, and an outdoor controller 50. The indoor unit 3 includes an expansion valve 15, an indoor heat exchanger 16, and an indoor controller (not shown). The outdoor units 2*a*,2*b* and the indoor unit 3 are connected by a liquid pipe 14 and a gas pipe 17.

Oil separator 6 is used for separating oil from the discharge gas and the separated oil then will be returned back to the compressor 4 through the suction line of the compressor 4.

The discharge check valve 8 is used for preventing the refrigerant and oil from flowing back to the stopped compressor while other compressors are operating.

The four-way valve 11 is used for selecting one of the two operating modes of the apparatus, i.e. cooling mode and heating mode.

The receiver tank 13 is used for separating the liquid refrigerant from the mixed (gas and liquid) refrigerant before the refrigerant flows to the expansion device.

The accumulator 18 is used for separating gas refrigerant from mixed refrigerant before the refrigerant flows back to the suction line of the compressor 4.

The outdoor controller 50 controls operation of the outdoor unit 2*a*, 2*b* and operation of the solenoid valve V1. Operation of the valve V1 will be explained in details later.

The compressor 4 is a high pressure type compressor. After the refrigerant pass a compression chamber of the compressor, the high pressure and high temperature refrigerant will flow inside the casing of the compressor for cooling the motor (not shown) and thereafter flow to the discharge pipe 5. During operation, interior of the compressor's casing is under high pressure. Lubrication oil L is stored inside the compressor's casing in the bottom. The discharge pipe 5 is connected between the discharge side (high-pressure side) of the compressor 4 and an inlet of the oil separator 6. The suction pipe 20 is connected between a suction muffler 21 of the compressor 4 and an outlet of the accumulator 18. The suction pipe 20 of the compressor 4 is connected for returning the refrigerant and the oil from the at least one indoor unit to the compressor 4.

The oil separator 6 is connected between compressor 4 and a discharge check valve 8. The inlet of the oil separator 6 is connected to the discharge pipe 5. The outlet of the oil separator 6 is connected to the high-pressure outlet pipe 7. A main discharge pipe 9 is connected between the discharge check valve 8 and the four-way valve 11. The oil return pipe 31 is connected between the bottom of the oil separator 6 and a capillary tube (pressure reduction device) 32. An oil return pipe 33 is connected between the capillary tube 32 and the suction pipe 20.

According to the first embodiment of the invention, an oil balancing circuit 60A is provided for each outdoor unit 2*a* and 2*b*. And each oil balancing circuit 60A includes an oil balancing pipe 22, an oil check valve 23, an oil balancing pipe 28, an oil solenoid valve V1, and an oil balancing pipe 30.

The oil balancing circuit is configured to allow a flowing-in of an excess amount of the oil L stored in the casing of the compressor 4.

The oil balancing pipe 22 is formed as a first exceeding oil passage connected in fluid communication between the side surface of the casing of the compressor 4 and the main discharge pipe 9 via oil check valve 23 and the oil solenoid valve V1. In other word, the oil balancing pipe 28 is connected between the oil check valve 23 and the oil solenoid valve V1. The solenoid valve V1 is interposed in the first exceeding oil passage for periodically controlling flow of the exceeding oil from the compressor 4 to the main discharge pipe 9. Further, the oil balancing pipe 30 is connected between the oil solenoid valve V1 and the main discharge pipe 9.

It should be noted that in case where there is only one high-pressure type compressor 4 equipped in the outdoor unit 2*a*, 2*b*, the main discharge pipe 9 becomes a main discharge pipe and functions for discharging refrigerant and oil to the at least one indoor unit 3. Also, the suction pipe 20 becomes a main suction pipe and function for returning the refrigerant and the oil from the at least one indoor unit 3 to the respective compressor 4.

(Explanation of Refrigerant Flow)

When the outdoor units 2*a*, 2*b* operate, the compressor 4 in each outdoor unit operates. The refrigerant and oil discharges from each compressor 4 flows through the discharge pipe 5 and flows into the oil separator 6. The discharge refrigerant is high pressure in gas phase. The discharge refrigerant gas contains lubricating oil most of which will be separated by the oil separator 6 and return to the compressor 4. The discharge refrigerant gas from which the lubricating oil is separated flows into the high-pressure outlet pipe 7 and flows pass through the discharge check valve 8 and to the main discharge pipe 9. The discharge refrigerant gas then flows pass through the four-way valve 11.

At the cooling mode operation, the discharge refrigerant gas flows to the outdoor heat exchanger 12. At this time, the outdoor heat exchanger 12 functions as a condenser. After passing the outdoor heat exchanger 12, the discharge refrigerant gas will be changed into a liquid phase and enters the receiver tank 13. The liquid refrigerant then passes a service valve 34*a* and flow into the liquid pipe 14 and go into the indoor unit 3 via a service valve 34*c*. The liquid refrigerant flows to the expansion valve 15 and enters the indoor heat exchanger 16 where it will be changed into a gas phase. The indoor heat exchanger 16 functions as an evaporator. The gas phase refrigerant will be suctioned pass another service valve 34*d* and flow into the gas pipe 17 and return to the outdoor unit 2*a*,2*b* through the service valve 34*b*. It then flows into the accumulator 18 and subsequently to the suction pipe 20 and suction muffler 21 of each compressor 4.

In the heating mode operation, the four-way valve 11 forces the refrigerant to flow in a reverse direction, comparing to that of the cooling mode operation. That is to say, the refrigerant will flow in the direction from the indoor heat exchanger 16 of the indoor unit 3 to the heat exchanger 12 of the outdoor unit 2*a*, 2*b*. In this case, the indoor heat exchanger 16 functions as a condenser, and the outdoor heat exchanger 12 functions as an evaporator. The remaining operation in the heating mode will be omitted since it is the same as those already aforementioned above.

(Explanation of Oil Return from Oil Separator)

When the discharge refrigerant gas and oil from compressor 4 of each outdoor unit 2*a*,2*b* flows pass the oil separator 6, the oil separated by the oil separator 6 will return to the compressor via the oil return pipe 31, the capillary tube 32, the oil return pipe 33 and the suction muffler 21, respectively.

(Explanation of Oil Flow in Oil Balancing Circuit Between Outdoor Unit)

Even the oil separator 6 is used, unbalance of oil level in compressor 4 in each outdoor unit 2*a*, 2*b* can still occur because the oil separator 6 cannot completely separate the oil from the mixed refrigerant. Typically, the oil separator 6 has an oil recovery efficiency around 90 to 99%. As a result, some of compressor oil L still flows through the circuit and remains in some parts of the circuit, such as the indoor unit 3, the accumulator 18, and the piping. Since not all of the lubricating oil L can return to the compressor 4, this may give rise to an unbalance oil level condition. Some compressors 4 may cause severe damages to the sliding motion parts of the compressor 4 without having sufficient lubricating oil L.

In case the oil L for lubrication in the compressor 4 of each outdoor unit 2*a*, 2*b* is high above the level of inlet of the oil balancing pipe 22 in the side surface of the casing of the compressor 4, the exceeding oil will flow to the oil balancing pipe 22. The exceeding oil flows through a first exceeding oil passage which is connected in fluid communication between the side surface of the casing of the compressor 4 and the main discharge pipe 9. That is, the exceeding oil passes through the oil check valve 23 and flows into the oil balancing pipe 28, the solenoid valve V1, and the oil balancing pipe 30. The exceeding oil then flows to the main discharge pipe 9 and pass through the four-way valve 11, the outdoor heat exchanger 12, the receiver tank 13, and the service valve 34*a*, respectively, and flows into the liquid pipe 14. From there, the exceeding oil passes through the service valve 34*c* of indoor unit 3, and the expansion valve 15, the indoor heat exchanger 16, the service valve 34*d* of indoor unit 3 and flows in to the gas pipe 17. Subsequently, the exceeding oil will return to each outdoor unit 2*a*, 2*b*. The exceeding oil will be divided and pass through service valve 34*b* of each outdoor unit that is currently operating and passes through the four-way valve 11 to the accumulator 18, and then flows into the suction pipe 20. The exceeding oil will pass through the suction muffler 21 and fill into each compressor 4 of each outdoor unit 2*a*, 2*b*. As a result, the oil level in each compressor 4 of each outdoor unit 2*a* and 2*b* becomes at the appropriate level.

It should be noted that the solenoid valve V1 in the oil balancing circuit of each outdoor unit is preferably opened and closed periodically for a predetermined time by the outdoor controller 50. For example, solenoid valve V1 may be opened for 1-2 minutes for every two hours of the compressor operating time, when there are more than one operating outdoor units 2*a*, 2*b*.

In the present invention, the oil balance circuit in each outdoor unit is assembled at the factory and is constructed as a built-in component of the outdoor unit. Therefore, there is no need to install the oil balancing pipe between each outdoor unit on site after installing the apparatus as it is in the conventional refrigerating cycle apparatus. This can prevent problems such as oil leakage, and clogging in the oil pipe.

(Explanation of Oil Balancing Logic)

Figure 2:
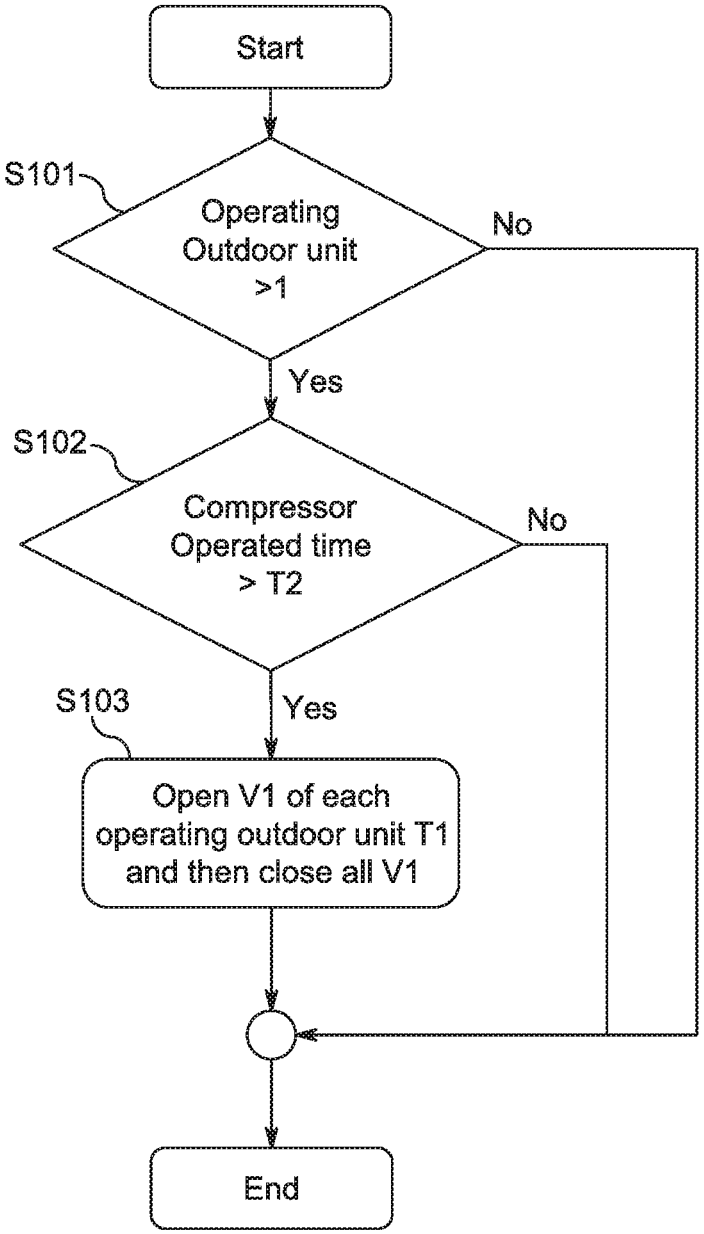
FIG. 2 is a flowchart for oil balancing control of the refrigerating cycle apparatus shown in FIG. 1.

Reference is now made to the flowchart shown in FIG. 2, the explanation will be made below about operation (oil balancing logic) of the outdoor controller 50.

The outdoor controllers 50 are connected to each other by communication wires and cooperate to control the operation of this refrigerating cycle apparatus.

At step S101, if the refrigerating cycle apparatus is operating with only single outdoor unit 2*a* or 2*b*, i.e. there is only one compressor 4 running, the oil balancing is not required. On the other hand, if the apparatus is operating with both outdoor unit 2*a* and 2*b* running ("Yes" at step S101), i.e. there is more than one compressor 4 running, the oil balancing is required. Then, the outdoor controller 50 of each outdoor unit 2*a* and 2*b* will detect operating time of each compressor 4. In the case where at least one compressor 4 among the plurality of compressors 4 is running continuously more than a second predetermined time T2 (for example, two hours), the oil solenoid valve V1 of each operating outdoor unit 2*a* and 2*b* will be opened for a first predetermined time T1, for example, for one minute to allow flowing of the exceeding oil from each compressor to the discharging pipe 9 and then be closed (Step S103). In case the operating compressor 4 is stopped before the predetermined time (in this example two hours) passes away, the oil balancing between each outdoor unit 2*a* and 2*b* is not required.

The oil balancing pipe installation problem manifested in the EP 2 397 793B1 can be solved by this present invention. The oil balancing circuit between each outdoor unit is already built-in each outdoor unit at the time of factory shipment. According to the first embodiment of the invention, oil level in each compressor 4 of each outdoor unit 2*a* and 2*b* can be efficiently maintained at an appropriate level by the outdoor unit controller 50.

Embodiment 2

Figure 3:
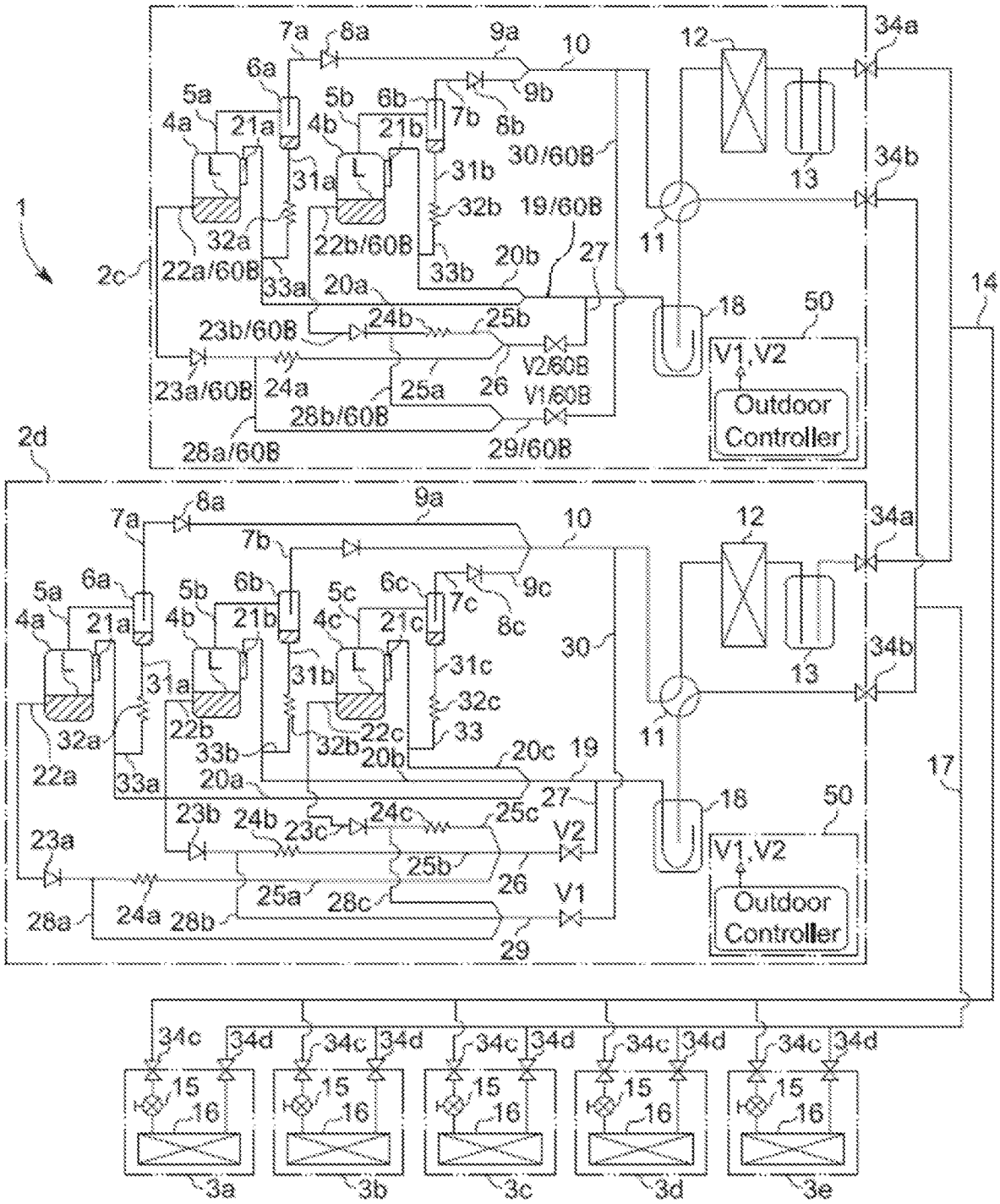
FIG. 3 is a circuit diagram of refrigerating cycle that included a plurality of compressors in each outdoor unit according to an embodiment 2 of the present invention.

An another embodiment of the present invention will be now described with respect to FIG. 3.

It should be noted that only the difference between the embodiment 1 and the embodiment 2 will be described below. The explanation of the common components will be omitted. The advantage of the second embodiment is explained as follows.

1. Each outdoor unit can have more than one high pressure type compressors. This can help expanding indoor unit connections. Further, the plurality of compressors can provide better performance comparing to that of an apparatus having one big-sized compressor. For example, one of the advantages of the multiple compressors is the ability to control refrigeration capacity finely.
2. In the second embodiment, there is a second oil balancing circuit in each outdoor unit, in addition to the oil balancing circuit described in the first embodiment. The first balancing circuit balances oil between each compressor in difference outdoor unit. Whereas, the additional second Oil balancing circuit balances oil between each compressor in the respective outdoor unit. This can provide more efficiency in oil balancing to the refrigerating cycle apparatus.

In FIG. 3, the refrigerating cycle apparatus comprises a plurality of outdoor units 2*c*,2*d* and a plurality of indoor units 3*a*-3*e*. The outdoor unit 2*c* have two compressors 4*a* and 4*b*, two oil separators 6*a* and 6*b*, two discharge check valves 8*a* and 8*b*, two discharge pipes 9*a* and 9*b*, a main discharge pipe 10, a four-way valve 11, an outdoor heat exchanger 12, a receiver tank 13, an accumulator 18 and an outdoor controller 50.

In the embodiment, the outdoor unit 2*d* have three compressors 4*a*,4*b* and 4*c*, three oil separators 6*a*,6*b* and 6*c*, three discharge check valves 8*a*,8*b* and 8*c*, three discharge pipes 9*a*,9*b* and 9*c*, a main discharge pipe 10, a four-way valve 11, an outdoor heat exchanger 12, a receiver tank 13, an accumulator 18 and a outdoor controller 50. Each of the indoor unit 3 includes an expansion valve 15, an indoor heat exchanger 16 and an indoor controller (not shown). The Plurality of the outdoor unit 2*c*,2*d* and the plurality of indoor unit 3*a*-3*e* are connected by a liquid pipe 14 and a gas pipe 17.

The outdoor controller 50 controls operation of the outdoor unit 2*c*,2*d* and operation of the oil solenoid valve V1 for oil balancing between outdoor unit 2*c* and 2*d*. Further, the outdoor controller 50 also controls the oil solenoid valve V2 for oil balancing between compressor 4*a*,4*b*,4*c* inside each outdoor unit 2*c*,2*d*.

The compressors 4*a*,4*b*,4*c* in each outdoor unit 2*c*,2*d* are high pressure type compressor. During operation, pressure inside compressor shell or casing is high. Lubrication oil L is contained inside the compressor casing at the bottom position. The discharge pipes 5a,5b,5c are connected between the discharge pipe of the compressor 4a,4b,4c and the inlet pipes of the oil separator 6a,6b,6c. The suction pipes 20a,20b,20c are connected between respective suction muffler 21a,21b,21c of the compressor 4a,4b,4c and a main suction pipe 19. The main suction pipe 19 is connected between the suction pipe 20a,20b,20c and the accumulator 18. The oil balancing pipes 22a,22b,22c are connected to an oil storage position above the bottom position of side surfaces of the respective compressor 4a,4b,4c.

The oil separators 6a,6b,6c in each outdoor unit 2c,2d are connected between the compressor 4a,4b,4c and the discharge check valve 8a,8b,8c. The inlet pipes of the oil separators 6a,6b,6c are connected to the discharge pipes 5a,5b,5c. The outlet pipes of oil separator 6a,6b,6c are connected to respective high pressure outlet pipe 7a,7b,7c. The oil return pipes 31a,31b,31c are connected between the oil return pipe of the oil separators 6a,6b,6c and the capillary tubes 32a,32b,32c. The oil retune pipes 33a,33b,33c are connected between the capillary tubes 32a,32b,32c and the suction pipes 20a,20b,20c. The discharge check valves 8a,8b,8c are connected between high pressure the outlet pipes 7a,7b,7c and the discharge pipes 9a,9b,9c.

In this embodiment, a first oil balancing circuit 60B in each outdoor unit 2c,2d includes an oil balancing pipe 22a,22b,22c, an oil check valve 23a,23b,23c, an oil balancing pipe 28a,28b,28c, an oil balancing pipe 29, an oil solenoid valve V1 and an oil balancing pipe 30. The oil balancing pipe 22a,22b,22c is respectively connected between side surface of compressor 4a,4b,4c and the oil balancing pipe 28a,28b28c. The oil check valve 23a,23b,23c is installed on the other end of the oil balancing pipe 22a,22b,22c. The Oil balancing pipe 28a,28b,28c each is branched out from the corresponding oil check valve 23a, 23b,23c, to an oil balancing pipe 29. The oil solenoid valve V1 is connected between the oil balancing pipe 29 and the oil balancing pipe 30 which is connected to the main discharge pipe 10.

The oil balancing circuit 60B of the second embodiment further comprises a second exceeding oil passage which is connected in fluid communication between the side surface of the respective compressor 4a, 4b, 4c and the main suction pipe 19. A second solenoid valve V2 is interposed in the second exceeding oil passage for controlling flow of the exceeding oil from each compressor 4a, 4b, 4c to the main suction pipe 19. Reference 60B is indicated by example in outdoor unit 2c of FIG. 3 only to avoid obscuring the figures.

The second exceeding oil passage balances oil between the compressors 4a,4b,4c in the same outdoor unit 2c,2d. Each of the second exceeding oil passage includes the oil balancing pipe 22a,22b,22c, the oil check valve 23a,23b, 23c, a capillary tube 24a,24b,24c for reduction of oil pressure, an oil balancing pipe 25a,25b,25c, an oil balancing pipe 26, an oil solenoid valve V2 and an oil balancing pipe 27. The oil balancing pipes 22a,22b,22c are connected between the side surface of compressor 4a,4b,4c and the oil check valve 23a,23b,23c. The capillary tubes 24a,24b,24c are connected to the respective oil check valves 23a,23b, 23c. The oil balancing pipes 25a,25b,25c are then jointly connected between the capillary tubes 24a,24b,24c and the oil balancing pipe 26. The above oil balancing pipes 28a, 28b, 28c respectively branch off from the position between the oil check valves 23a, 23b, 23c and the capillary tubes 24a, 24b, 24c. The oil balancing pipe 26 is connected to the oil solenoid valve V2. The oil solenoid valve V2 is connected to the main suction pipe 19 via the oil balancing pipe 27.

(Explanation of Refrigerant Flow)

Refrigerant flow of the refrigerating cycle apparatus 1b in the second embodiment is the same as refrigerant flow of the refrigerating cycle apparatus 1a explained in the first embodiment above.

The differences between the embodiment 1 and embodiment 2 are explained below.

1. In embodiment 1, the refrigerant flow in one outdoor unit is from one high pressure type compressor, while in the embodiment 2 the refrigerant flow in one outdoor unit is from more than one compressors.

2. In this embodiment, discharged gas being discharged from two or three compressors will flow from the discharge pipes 9a,9b,9c and be mixed to the main discharge pipe 10.

3. In this embodiment, suction gas flow being suctioned from the main suction pipe 19 will be separated to each compressor by the suction pipe 20a,20b,20c.

(Explanation of Oil Return from Oil Separator)

In this embodiment, the oil return from the oil separators 6a,6b,6c in the outdoor unit 2c and 2d are the same as oil return from the oil separator 6 in outdoor unit 2a and 2b in the embodiment 1. Therefore, the explanation is omitted.

(Explanation of Oil Flow in Oil Balancing Circuit Between the Outdoor Units)

In case the amount of oil L in some compressors 4a,4b,4c in each outdoor unit 2c and 2d is high above the connection position on a side surface of the respective oil balancing pipe 22a,22b,22c. The exceeding oil L flows into the oil balancing pipe 22a,22b,22c from inside of the compressor casing and flow pass the oil check valve 23a,23b,23c into either one of the following passages depending on conditions of operation:

1) the oil balancing pipe 28a,28b,28c, the oil balancing pipe 29, the oil solenoid valve V1, the oil balancing pipe 30, and the main discharge pipe 10. and 2) the capillary tubes 24a,24b,24c, the oil balancing pipe 25a,25b,25c, the oil balancing pipe 26, the oil solenoid valve V2, the oil balancing pipe 27 and the main suction pipe 19.

The above 1) is the oil balancing circuit between the outdoor units and 2) is the oil balancing circuit between compressors inside outdoor unit.

The following is an explanation about the flow of the exceeding oil in the oil balancing circuit between the outdoor units shown in 1).

The exceeding oil flows to the main discharge pipe 10 and pass the four-way valve 11, the outdoor heat exchanger 12, the receiver tank 13, the service valve 34a, and then flows into the liquid pipe 14. The exceeding oil then flows pass the service valve 34c of respective indoor unit 3a-3e, pass the expansion valve 15, the indoor heat exchanger 16, and pass the service valve 34d of each indoor unit 3a-3e and flows into the gas pipe 17. From there, the exceeding oil then flows back to each outdoor unit 2c and 2d and flows pass through service valve 34b and passes the four-way valve 11, the accumulator 18 and then flow into the main suction pipe 19. The exceeding oil is then suctioned into the suction pipe 20a,20b,20c and fill in each compressor 4a,4b,4c in each outdoor unit 2c and 2d via the suction muffler 21a,21b,21c. Thereby, the oil level in each compressor 4a,4b,4c of each outdoor unit 2c and 2d will be filled up to an appropriate level.

(Explanation of Oil Flow in Oil Balancing Circuit Between Compressors Inside Outdoor Unit)

Next, the flow of the exceeding oil in the oil balancing circuit between compressors inside outdoor unit shown in 2) will be explained.

The exceeding oil flows into the respective oil balancing pipe 22*a*,22*b*,22*c* and passes through the oil check valve 23*a*,23*b*,23*c* and the capillary tube 24*a*,24*b*,24*c* and then flows into the oil balancing pipe 25*a*,25*b*,25*c* and jointly flows into the oil balancing pipe 26. The exceeding oil flows through the oil solenoid valve V2 in controllable manner and flows to the main suction pipe 19 via the oil balancing pipe 27. Consequently, the exceeding oil will be suctioned into the suction pipe 20*a*,20*b*,20*c* and fill in each compressor 4*a*,4*b*,4*c* in each outdoor unit 2*c* and 2*d* via the suction muffler 21*a*,21*b*,21*c*. Thereby, the oil level in each compressor 4*a*,4*b*,4*c* of each outdoor unit 2*c* and 2*d* can be efficiently filled up to an appropriate level.

(Explanation of Oil Balancing Logic)

Figure 4:
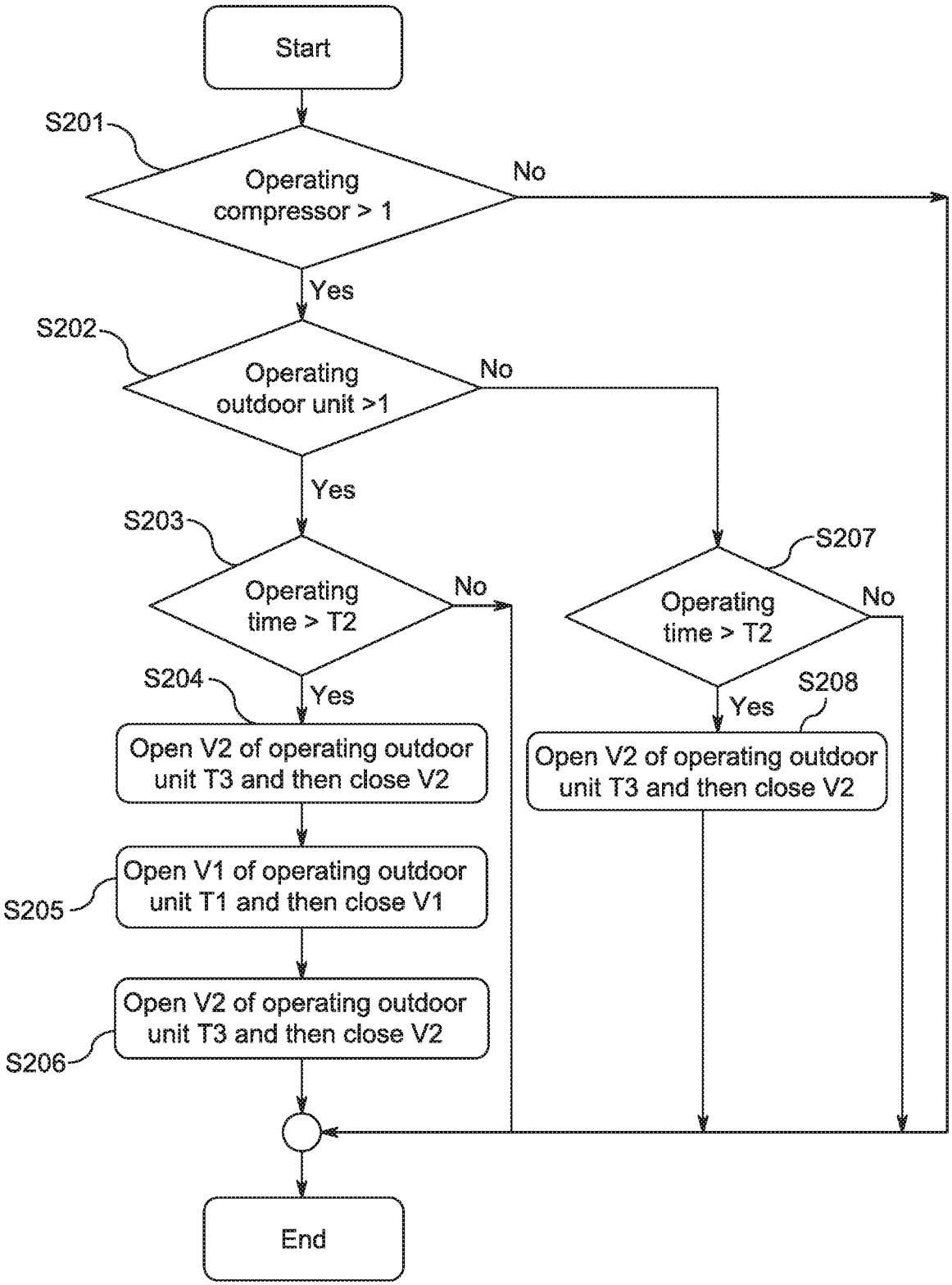
FIG. 4 is a flowchart for oil balancing control of the refrigerating cycle apparatus shown in FIG. 3.

The oil balancing logic performed by each outdoor controller 50 will be explained with reference to FIG. 4.

At step S201, if the apparatus is operating with only single outdoor unit 2*c* or 2*d* and there is only one compressor 4*a*,4*b* or 4*c* being operated ("No" at step S201), the oil balancing is not required. On the other hand, if the apparatus is operating using multiple compressors 4*a*,4*b*,4*c* ("Yes" at step S201) and if the outdoor unit is operated using only single outdoor unit 2*c* or 2*d* ("No" at step S202), the oil balancing between compressors inside the same outdoor unit 2*c* or 2*d* is required but oil balancing among the outdoor units 2*c* and 2*d* is not required, only when the outdoor controller 50 detects that at least one compressor 4*a*,4*b* or 4*c* is running continuously longer than a fourth predetermined time T4 ("Yes" at step S207). The fourth predetermined time T4 is, for example, two hours. Thereby, the solenoid valve V2 of the operating outdoor unit 2*c* or 2*d* will be opened for a third predetermined time T3 to allow the exceeding oil from the respective compressor to flow from the operating compressors to the main suction pipe 19 and then the solenoid valve V2 closed (Step S208). The third predetermined time T3 is, for example, one minute. Otherwise ("No" at step S207), the oil balancing is not required.

If the apparatus is operated by multiple compressor 4*a*,4*b*, 4*c* ("Yes" at step S201) and operated by multiple outdoor units 2*c* and 2*d* ("Yes" at step S202), in this case, both of oil balancing between compressors inside the respective outdoor unit 2*c* or 2*d* and oil balancing among outdoor units 2*c* and 2*d* are required, only when the outdoor controller 50 detects that at least one compressor 4*a*,4*b* or 4*c* is running continuously longer than a second predetermined time T2 ("Yes" at step S203). The second predetermined time T2 is, for example, two hours. Consequently, the oil solenoid valve V2 of the respective operating outdoor unit 2*c* or 2*d* will be opened for the third predetermined time T3 and then closed (Step S204). After that, the oil solenoid valve V1 of the operating outdoor unit 2*c* or 2*d* will be opened for the first predetermined T1 and then closed (Step S205). The first predetermined time T1 is, for example, one minute. Later, the oil solenoid valve V2 of the operating outdoor unit 2*c* or 2*d* will be opened again for one min and then closed (Step S206). In other words, the first solenoid valve V1 and the second solenoid valve V2 of the operating outdoor unit are alternatively opened and closed in sequence one after another. In this embodiment, oil balance between the compressors 4*a*, 4*b*, 4*c* in each outdoor unit 2*c*, 2*d* is implemented in the steps S204, S206, and/or S208 and oil balance between compressors in different outdoor units is implemented in the step S205.

When oil level unbalance situation occurs in some of the plurality of compressors in any outdoor unit 2*c*, 2*d*, the compressors 4*a*, 4*b*, 4*c* having insufficient oil can get lubrication oil from other compressors 4*a*, 4*b*, 4*c* in same outdoor unit much more quickly by performing the step S204. Next, the compressors 4*a*, 4*b*, 4*c* can get further oil from other compressors in the difference outdoor units during the step S205. However, after performing the step S205, oil level in each one of the compressors in the same outdoor unit may be unbalanced. The step S06 is performed again so as to balance the oil level of the compressors 4*a*, 4*b*, 4*c* in the same outdoor unit 2*c*, 2*d*. As a result, by performing oil balancing procedure periodically and in sequence as mentioned above, the oil level in each compressor 4*a*, 4*b*, 4*c* of each outdoor unit 2*c*, 2*d* can be maintained in an appropriate level.

It should be understood by skilled people in the art that the sequence above is only an exemplary operation and number of times and sequence for performing oil balance between the compressors in the same outdoor unit and oil balancing between the outdoor units can be varied or modified dependent on other factors and operating conditions designed for specific apparatus, such as size of the high pressure compressors, number of the indoor units and outdoor units, installations of the, and the like. For example, the apparatus may be configured to omit the step S204 and perform only the steps S205 and S206. The oil level in each compressors still become in an appropriate level. However, it is preferable to perform the step S204, since the oil in each compressor will be at appropriate level more quickly. After opening and closing the first solenoid valve V1 of the operating outdoor unit 2*c*, 2*d*, it is preferable to perform the step of opening and closing the second solenoid valve (V2).

Embodiment 3

Figure 5:
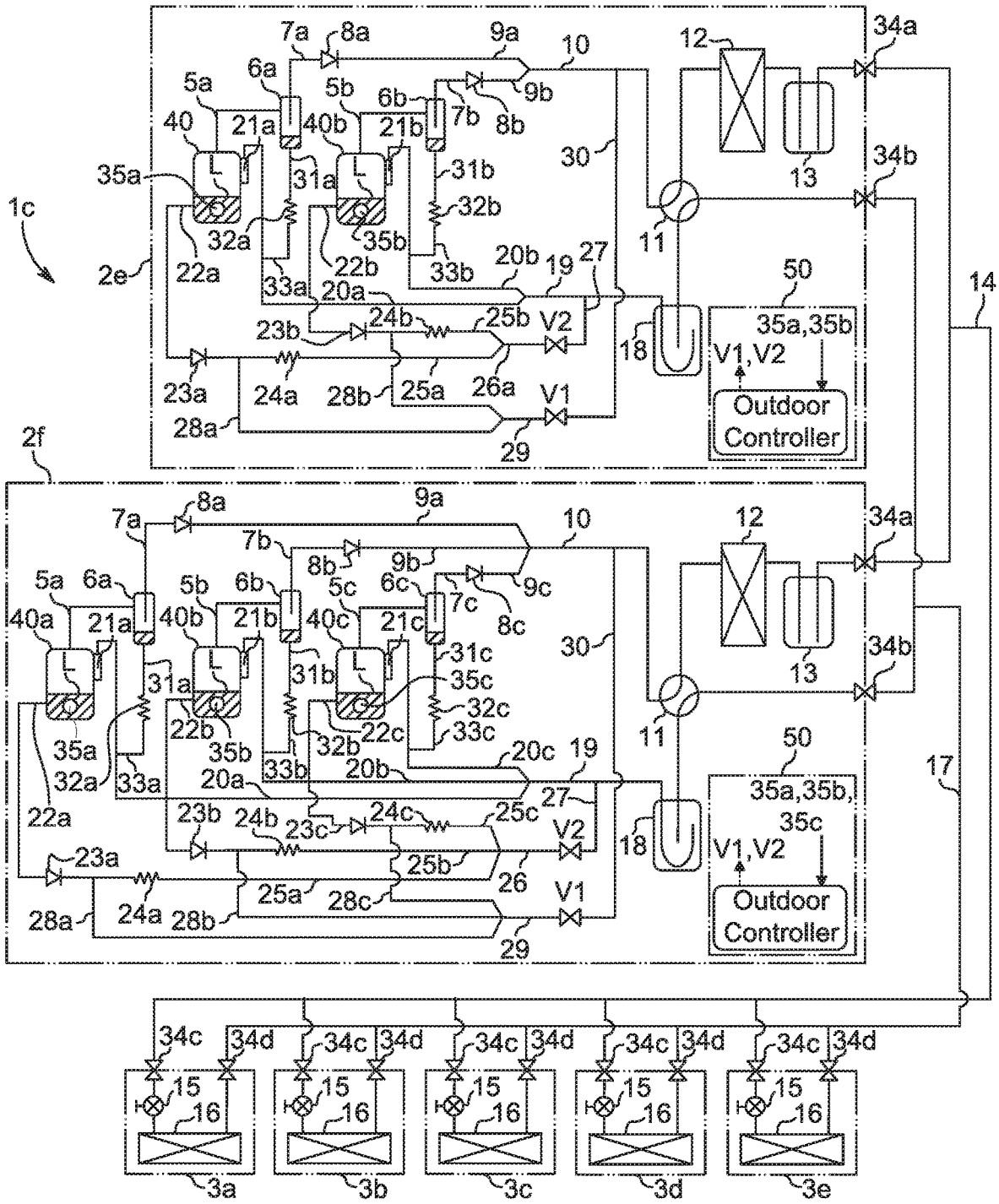
FIG. 5 is a circuit diagram of refrigerating cycle that included a plurality of compressors with an oil level sensor in each compressor according to an embodiment 3 of the present invention.

The embodiment 3 of the present invention will be described with reference to FIG. 5 As illustrated in FIG. 5, the embodiment 3 is almost the same as that of the embodiment 2, except that every compressors in the embodiment 3 is equipped with an oil level sensor 35*a*, 35*b*, and 35*c*. The oil level sensor 35*a*, 35*b*, 35*c* is a sensor for detecting oil level of the lubrication oil L in the casing of the respective compressor. Output of the oil level sensor 35*a*, 35*b*, 35*c* will be used in oil balancing for the respective compressor 40*a*, 40*b*, 40*c* in the outdoor unit 2*e*, 2*f*. An oil level sensor may be a capacitive type oil level sensor, or the like. The oil level sensor is, for example, disclosed in EP 2 772 731 A1 publication, entitled "The electrostatic capaciative liquid surface sensor".

In this embodiment, a refrigerating cycle apparatus 1*c* is configured between a plurality of outdoor units 2*e*, 2*f* and a plurality of indoor units 3*a*-3*e*. All components, as well as piping and connections inside the outdoor unit 2*e* and 2*f* are the same as those of the outdoor unit 2*c* and 2*d* in the embodiment 2, respectively. However, this embodiment is different from the embodiment 2 in that the compressors 40*a* and 40*b* are equipped with the oil level sensors 35*a*, and 35*b*, respectively. Therefore, explanation for those similar components as those of the above described first and second embodiments will be omitted.

The outdoor controller 50 controls operation of the outdoor unit 2*e*,2*f* and operation of the oil solenoid valve V1 for oil balancing between different outdoor units 2*e* and 2*f* and control the oil solenoid valve V2 for oil balancing between the compressors 40*a*,40*b*,40*c* in the same outdoor unit. The outdoor controller 50 will perform oil balancing based on the detection results from the oil level sensor 35*a*, 35*b*, 35*c* of each compressor. Further details of operation will be described below.

(Explanation of Refrigerant Flow)

Refrigerant flow in the refrigerating cycle apparatus 1*c* is the same as the refrigerant flow in the refrigerating cycle apparatus 1*b* explained in the embodiment 2.

(Explanation of Oil Return from Oil Separator)

Oil return from the oil separator 6*a*,6*b*, 6*c* in the outdoor unit 2*e* and 2*f* is the same as the oil return from the oil separator 6*a*,6*b*,6*c* in the outdoor unit 2*c* and 2*d* as explained in the embodiment 2.

(Explanation of Oil Flow in Oil Balancing Circuit Between Outdoor Units)

Oil flow in each one of the oil balancing circuit between the outdoor units 2*e* and 2*f* is the same as oil flow in each one of the oil balancing circuit between outdoor units 2*c* and 2*d* as explained in the embodiment 2.

(Explanation of Oil Flow in Oil Balancing Circuit Between the Compressors Inside Outdoor Unit)

Oil flow in the oil balancing circuit between compressor 40*a*,40*b*,40*c* of the outdoor unit 2*e* and 2*f* is the same as oil flow in the oil balancing circuit between the compressors 4*a*,4*b*,4*c* of the outdoor units 2*c* and 2*d* as explained in the embodiment 2.

(Explanation of the Oil Balancing Logic)

Figure 6:
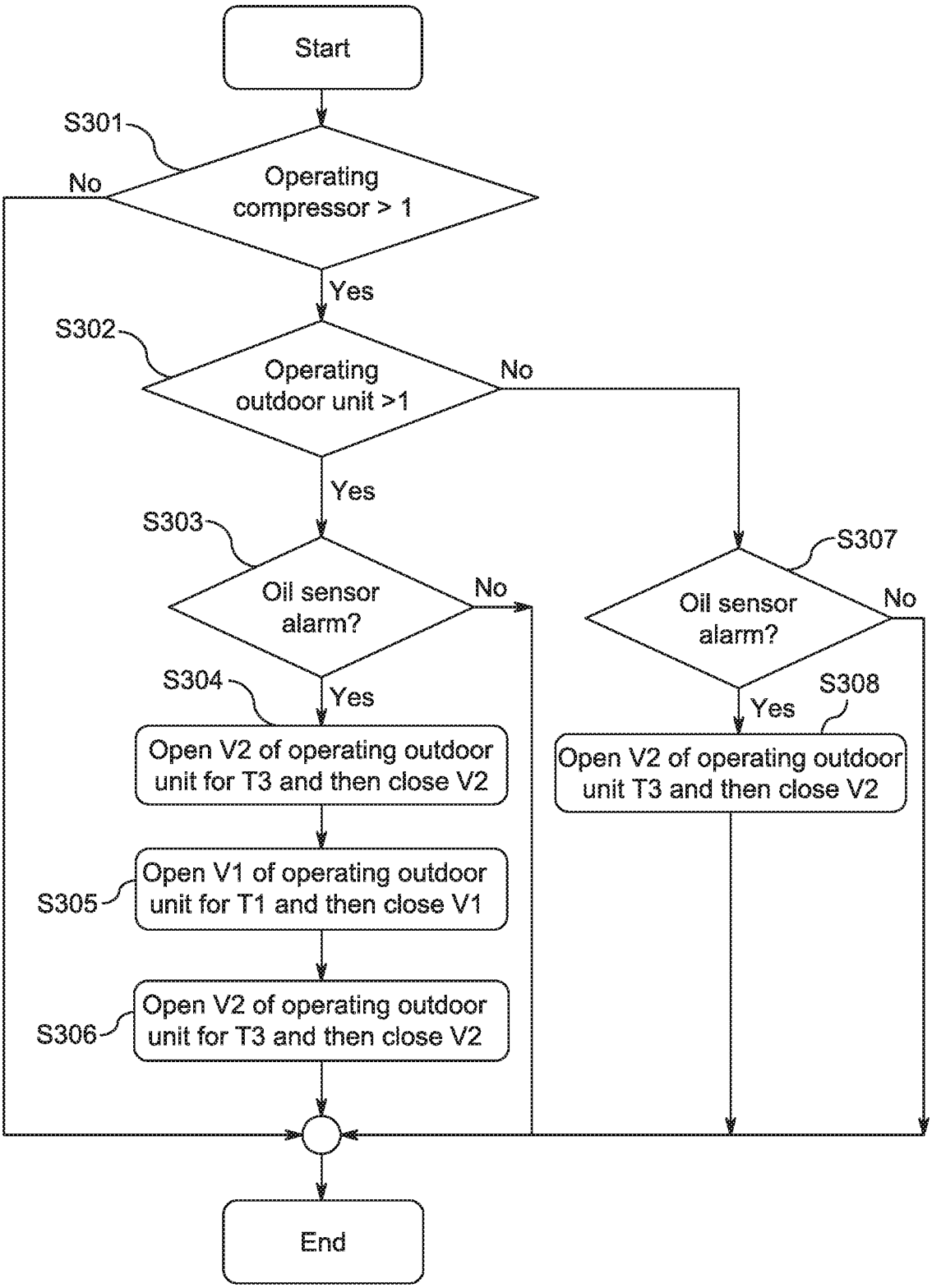
FIG. 6 is a flowchart for oil balancing control of the refrigerating cycle apparatus shown in FIG. 5.

Oil balancing logic in the outdoor controller 50 is explained by referring to FIG. 6. If the apparatus is operating using only one outdoor unit 2*e* or 2*f* and utilizes one compressor 40*a*, 40*b* or 40*c*, the oil balancing is not required ("No" at step S301). If the apparatus is operating by multiple compressors 40*a*,40*b*,40*c* ("Yes" at step S301) and utilize only one outdoor unit 2*e* or 2*f* ("No" at step S302), the oil balancing between compressors in the same outdoor unit 2*e* or 2*f* is required, but oil balancing between the outdoor units 2*e* and 2*f* is not required.

Then, the outdoor controller 50 is detecting an amount of the oil L in the compressor 40*a*,40*b*,40*c* using the oil level sensor 35*a*,35*b*,35*c*, respectively during operation. In case the amount of the oil L in some compressors 40*a*, 40*b* or 40*c* is below a predetermined level (i.e. too low) ("Yes" at step S307), the controller 50 will then start to perform the oil balancing between the compressors in the same outdoor unit to allow flowing of the exceeding oil from each compressor to the main suction pipe 19 and return to each compressors 40*a*, 40*b*, 40*c*. The oil solenoid valve V2 of the operating outdoor unit 2*e* or 2*f* will be opened for the third predetermined time T3 (for example, one minute), and then closed (Step S308).

In case the apparatus is operating by multiple compressors 40*a*,40*b*,40*c* ("Yes" at step S301) and utilize multiple outdoor units 2*e* and 2*f* ("Yes" at step S302), both oil balancing between the compressors 40*a*, 40*b*, 40*c* in the same outdoor units and oil balancing between the outdoor units 2*e* and 2*f* are required. The outdoor controller 50 of each outdoor units 2*e* and 2*f* detect the amount of the oil L in each compressors 40*a*, 40*b*, 40*c* using the oil level sensor 35*a*,35*b*,35*c*, respective. If the oil amount in some compressors 40*a*, 40*b* or 40*c* is below the predetermined level or "too low" ("Yes" at step S303), the oil solenoid valve V2 in all operating outdoor unit 2*e* and 2*f* will be opened for the third predetermined time T3 (for example, one minute), and then closed (Step S304) in order to allow the exceeding oil flow to the main suction pipe 19, thereby balancing the oil level in the compressors 40*a*, 40*b*, 40*c* of the same outdoor unit. Then, the oil solenoid valve V1 in all operating outdoor unit 2*e* and 2*f* will be opened for the first predetermined time T1 (for example, one minute), and then closed (Step S305) in order to allow the exceeding oil flow to the main discharge pipe 10, thereby balancing the oil level in between the operating outdoor units 2*e*, 2*f*. Later, in the Step S306, the oil solenoid valve V2 of all operating outdoor unit 2*e* and 2*f* will be opened for the third predetermined time T3 (for example, one minute), and then closed in order to allow the exceeding oil flow to the main suction pipe 19, thereby balancing the oil level in the compressors 40*a*, 40*b*, 40*c* of the same outdoor unit again. In case the amount of oil L in compressor 40*a*,40*b* and 40*c* of each outdoor unit 2*e* and 2*f* is in an appropriate level ("No" at step S303), the oil balancing is not required.

In the step S305, if it is found out that the oil level of all the compressors is at the appropriate level by the output of the oil level sensor 35*a*, 35*b*, 35*c* before the first predetermined time T1 elapses, the first solenoid valve V1 of each operating outdoor unit may be closed, and step S306 may be omitted.

In this embodiment, oil balancing is controlled by the virtue of sensing oil level by the oil level sensors, instead of sensing the compressor's running time. It is considered to have more advantages than other embodiments because oil balancing will be performed only when it is actually required, that is, only when the oil level in each compressor is not in an appropriate level. Therefore, the embodiment 3 of the present invention has a better performance.

REFERENCE SIGN LIST

1*a*, 1*b*, 1*c*: Refrigerant cycle apparatus.
2*a*,2*b*,2*c*,2*d*,2*e*,2*f*: Outdoor unit.
3,3*a*,3*b*,3*c*,3*d*,3*e*: Indoor unit.
4,4*a*,4*b*,4*c*,40*a*,40*b*,40*c*: High pressure type compressor.
5,5*a*,5*b*,5*c*: Discharge pipe.
6,6*a*,6*b*,6*c*: Oil separator.
7,7*a*,7*b*,7*c*: High pressure outlet pipe.
8,8*a*,8*b*,8*c*: Discharge check valve.
9: Main discharge pipe.
9*a*,9*b*,9*c*: Discharge pipe.
10: Main discharge pipe.
11: 4 way valve.
12: Outdoor heat exchanger.
13: Receiver tank.
14: Liquid pipe.
15: Expansion valve.
16: Indoor heat exchanger.
17: Gas pipe.
18: Accumulator.
19: Main suction pipe.
20,20*a*,20*b*,20*c*: Suction pipe.
21,21*a*,21*b*,21*c*: Suction muffler.
22,22*a*,22*b*,22*c*,28,28*a*,28*b*,28*c*,29,30,25*a*,25*b*,25*c*,26,27: Oil balancing pipe.
23,23*a*,23*b*,23*c*: Oil check valve.
24*a*,24*b*,24*c*,32,32*a*,32*b*,32*c*: Capillary tube.
31,31*a*,31*b*,31*c*,33,33*a*,33*b*,33*c*: Oil return pipe.
34*a*,34*b*,34*c*,34*d*: Service valve.
35,35*a*,35*b*,35*c*: Oil level sensor.
50: Outdoor controller
V1,V2: Solenoid valve

The invention claimed is:

1. A refrigerating cycle apparatus with a plurality of outdoor units each of which is equipped with at least two high pressure type compressors and an outdoor controller, each of the high pressure type compressors having a casing stored with an oil; a discharge pipe; and a suction pipe, a main discharge pipe to which the discharge pipe of the at least two high pressure type compressors is connected, the main discharge pipe and the discharge pipe adapted to jointly discharge refrigerant and oil to at least two indoor units, and a main suction pipe to which the suction pipe of the at least two high pressure compressors is connected adapted to return the refrigerant and the oil from the at least two indoor units to the compressors, wherein each one of the plurality of outdoor units comprising:

an oil balancing circuit into which flows, from each of the respective at least two compressors, an excess amount of the oil stored in the casing of the respective compressor, including:

a first exceeding oil passage connected in fluid communication between a side surface of the casing of each one of the respective at least two compressors and the main discharge pipe, the first exceeding oil passage including for each one of the compressors a first oil balancing pipe connected to the side surface of each one of the compressors and a second oil balancing pipe, the second oil balancing pipes are joined together at a third oil balancing pipe which is connected to the main discharge pipe;

a first solenoid valve interposed in the third oil balancing pipe in the first exceeding oil passage controlling flow of the exceeding oil from each one of the respective at least two compressors to the main discharge pipe;

a second exceeding oil passage connected in fluid communication between the side surface of the casing of each one of the respective at least two compressors and the main suction pipe, the second exceeding oil passage including for each one of the compressors the first oil balancing pipe, a capillary tube, and a fourth oil balancing pipe, the fourth oil balancing pipes are joined together at a fifth oil balancing pipe which is connected to the main suction pipe;

wherein for each one of the compressors the first oil balancing pipe is branched into the second oil balancing pipe of the first exceeding oil passage and the capillary tube of the second exceeding oil passage; and a second solenoid valve interposed in the fifth oil balancing pipe in the second exceeding oil passage controlling flow of the exceeding oil from each one of the respective at least two compressors to the main suction pipe, and wherein the outdoor controller controls operations of the first solenoid valve and operations of the second solenoid valve.

2. The refrigerating cycle apparatus according to claim 1, wherein in the case that the plurality of outdoor units are operated and at least one of the high pressure type compressors is running continuously longer than a second predetermined time, each outdoor controller of the plurality of outdoor units which are operated opens the second solenoid valve for a third predetermined time, closes the second solenoid valve, opens the first solenoid valve for a first predetermined time, and then closes the first solenoid valve.

3. The refrigerating cycle apparatus according to claim 1, wherein each of high pressure type compressors is equipped with an oil level sensor which detects an oil level of the oil stored in the casing of the respective compressor.

4. The refrigerating cycle apparatus according to claim 3, wherein in the case that the plurality of outdoor units are operated and at least one of the oil levels which are detected by the oil level sensors of the at least two high pressure type compressors is below a predetermined level, each outdoor controller of the plurality of outdoor units which are operated opens the second solenoid valve for a third predetermined time, closes the second solenoid valve, opens the first solenoid valve for a first predetermined time, and then closes the first solenoid valve.

5. The refrigerating cycle apparatus according to claim 2, wherein after closing the first solenoid valve, the outdoor controller further opens the second solenoid valve for the third predetermined time, and then closes the second solenoid valve.

6. The refrigerating cycle apparatus according to claim 2, wherein the outdoor controller controls operations of the first solenoid valve and operations of the second solenoid valve by means of the following successive steps:

opening the second solenoid valve for the third predetermined time;

closing the second solenoid valve after opening the second solenoid valve for the third predetermined time;

opening the first solenoid valve for the first predetermined time after closing the second solenoid valve;

closing the first solenoid valve after opening the first solenoid valve for the first predetermined time;

opening the second solenoid valve for the third predetermined time again after closing the first solenoid valve; and closing the second solenoid valve after opening again the second solenoid valve for the third predetermined time.

* * * * *